United States Patent [19]

Aiuola et al.

[11] Patent Number: 4,846,777

[45] Date of Patent: Jul. 11, 1989

[54] HIGH-SPEED APPARATUS FOR THE EXTRACTION AND THE OPENING OF BAGS CONTAINED IN A MAGAZINE IN A FLATTENED CONDITION

[75] Inventors: Franco Aiuola; Alberto Mondani, both of Bologna, Italy

[73] Assignee: A.C.M.A. S.p.A, Bologna Bo, Italy

[21] Appl. No.: 96,194

[22] Filed: Sep. 14, 1987

[30] Foreign Application Priority Data

Sep. 22, 1986 [IT] Italy ..... 3512 A/86

[51] Int. Cl.[4] ..... B65B 43/30; B31B 5/00

[52] U.S. Cl. ..... 493/317; 493/316; 493/319

[58] Field of Search ..... 493/313, 316, 317, 319

[56] References Cited

U.S. PATENT DOCUMENTS

| | | | |
|---|---|---|---|
| 3,888,164 | 6/1975 | Taddei | 493/316 |
| 4,029,001 | 6/1977 | Reichert | 493/317 |
| 4,340,380 | 7/1982 | Calvert | 493/316 |
| 4,468,214 | 8/1984 | Grundler | 493/319 |
| 4,579,551 | 4/1986 | Ulrich et al. | 493/23 |

*Primary Examiner*—Frederick R. Schmidt
*Assistant Examiner*—William E. Terrell
*Attorney, Agent, or Firm*—Guido Modiano; Albert Josif

[57] ABSTRACT

High speed apparatus for the extraction and opening of bags contained in a magazine in which they are arranged in a flattened condition so as to form a pack. The apparatus is composed of a pair of extracting devices comprising elements provided with suction cups and supported oscillating between a position of extraction of the bags from the magazine and one of release of said bags onto a receiving device. The suction elements are actuated in opposite phase so that while one element, after extracting the related bag, is about to transfer it onto the receiving device, the other element is in the return phase. In order to prevent the extracting elements from colliding with one another, it is provided that the path followed by the elements during the extracting and transfer phase be different from the path followed during the return phase. The apparatus also provides an extended time for opening the bags.

6 Claims, 5 Drawing Sheets

HIGH-SPEED APPARATUS FOR THE EXTRACTION AND THE OPENING OF BAGS CONTAINED IN A MAGAZINE IN A FLATTENED CONDITION

BACKGROUND OF THE INVENTION

The present invention relates to an apparatus operating at high speed for the extraction and the opening of bags contained in a magazine in which they are arranged in a flattened or closed condition so as to form a pack.

Apparatuses of this type are already known and currently on the market. They comprise suction cup elements which are actuated so as to oscillate between a position of resting and extraction of the bag to be extracted and one of release of the extracted bag in an adapted seat of a conveyor for removal. With known apparatuses it is possible to achieve rather high operating speeds, although such speeds are limited by the need to introduce air into the newly extracted bags and by the fact that the return stroke of the suction cups from the release position to the extraction position requires a certain time which is in any case a dead time.

SUMMARY OF THE INVENTION

The technical aim of the present invention is therefore to provide an apparatus with which the above described disadvantages are substantially eliminated.

This aim is achieved by an apparatus characterized in that it comprises first and second suction cup extraction elements supported so as to oscillate between a position of extraction of the bags from a magazine and one of release thereof onto a receiving device, said first and second elements being operated in opposite phase.

BRIEF DESCRIPTION OF THE DRAWINGS

Further characteristics and advantages of the present invention will become apparent from the following description of a preferred embodiment, illustrated only by way of non-limitative example in the accompanying drawings, wherein.

DESCRIPTION OF THE PREFERRED EMBODIMENTS

Figure 1:
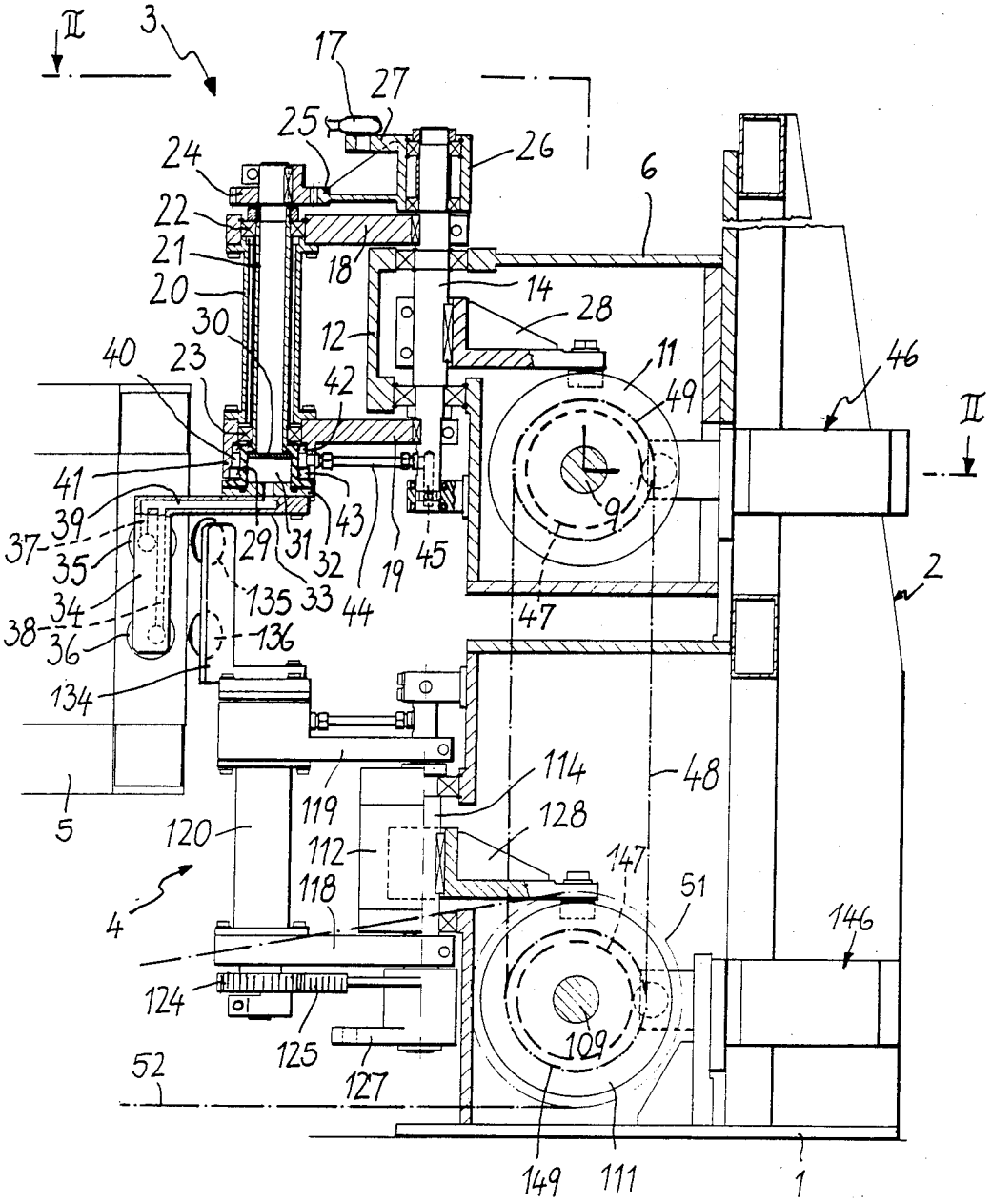
FIG. 1 is a lateral elevation view of the apparatus, in partial cross section along the plane I—I of FIG. 2.

The illustrated apparatus comprises a base 1 wherefrom rises a box-like column, generally indicated by the reference numeral 2.

Two superimposed devices 3, 4 are protrudingly fixed to the column 2, and are substantially identical to one another each being adapted for the extraction of a bag 5 from a magazine wherein the bags are arranged, in a flattened or closed condition, so as to form a pack.

The device 3 comprises a case 6 in the shape of a rectangular prism, with two sides 7, 8 in which a driven cycle shaft 9 is rotatably supported. Two cylinder cams 10, 11 are keyed on the shaft 9 and are respectively provided with peripheral grooves which are closed in a loop and have a preset path.

A box-like bracket 12 protrudes from the case 6, and two further parallel and vertical shafts 13, 14 are rotatably supported in said bracket. A layer is keyed on the shaft 13 and is provided with two radial arms 15, 16 the first 15 whereof bears a roller engaged with the cam 10, while an end of a tension element 17 is articulated to the end of the second 16. The shaft 14 extends with its opposite ends above and below the bracket 12 and two parallel plates 18, 19 are rigidly associated with said ends and are mutually connected by a sleeve 20 which is parallel to the shaft 14 and is provided with flanges for coupling to the plates 18, 19.

Inside the sleeve 20 there extends a hollow shaft or tube 21 which is driven through adapted seats of the plates 18, 19 at which it is rotatably supported by bearings 22, 23. At the top of the tube 21, overlying the upper plate 18, a pinion 24 is keyed and engages with a sector 25 rigidly associated with a bush 26 rotatably supported by the upper portion of the shaft 14 and provided with a projection 27 whereto is connected the other end of the tension element 17.

A lever 28, provided with a roller for engaging with the cylinder cam 11, is fixed to the shaft 14 in the portion thereof which is located inside the bracket 12.

From what has been described up to this point, it can be seen that the cam 11, by means of the lever 28, is capable of imparting a rotary motion to the shaft 14 causing the oscillation of the plates 18, 19 and therefore of the tube 21. Similarly, the cam 10, by means of the arms 15, 16 and of the tension element 17, determines the oscillation of the sector 25 and therefore the rotation of the tube 21 inside the sleeve 20.

The tube 21 is provided, at the lower end, with a sort of cup 29 the bottom whereof is closed by a disc 30 which defines a chamber 31. The chamber 31 is closed by a plate 32 with the interposition of a sealing ring. A diametral seat is provided on the plate 32, and an L-shaped lever is inserted and fixed therein and comprises a horizontal or radial arm 33 and a vertical arm 34, parallel to the tube 21, extending downwards. Two suction cups 35, 36 are arranged one above the other on the vertical arm 34 and are connectable to suction means. The connection is provided by means of two channels 37, 38 which lead from the suction cups 35, 36 into a single channel 39 of the horizontal arm 33 constantly connected to the chamber 31.

The chamber 31 is connected, through a peripheral passage of the cup 29, to an annular chamber 40, defined outside the cup 29 by a cylindrical collar 41 and by a pair of interposed sealing rings 42, 43.

The annular chamber 40 is connected by means of a flexible duct 44 to an axial hole 45 of the shaft 14, said hole being in turn connected to a suction source through a distributor generally indicated by 46. The distributor 46 is controlled by a cam 47 mounted on the shaft 9 between the cams 10, 11.

The shaft 9 is driven by the underlying device 4 by means of a chain 48 which winds on a toothed wheel 49 keyed to the shaft 9.

The extraction device 4 is substantially specularly identical to the above described device 3 and therefore for the sake of brevity in description, the elements of the device 4 which are identical or similar to those of the device 3 are indicated by the same reference numerals increased by 100.

In particular, it should be noted that the suction cups 135, 136 are arranged at the same height as the suction cups 35, 36 but in a position which is angularly offset with respect thereto. The differences between the device 4 and the device 3 consist of the increased length of the shaft 109 due to the presence of an additional cam 50 and of a first toothed wheel 51 whereon engages the chain 52 for driving both extraction devices. The chain 52 also engages a second toothed wheel 52*a* keyed to the main cycle shaft 52*b*.

Figure 3:
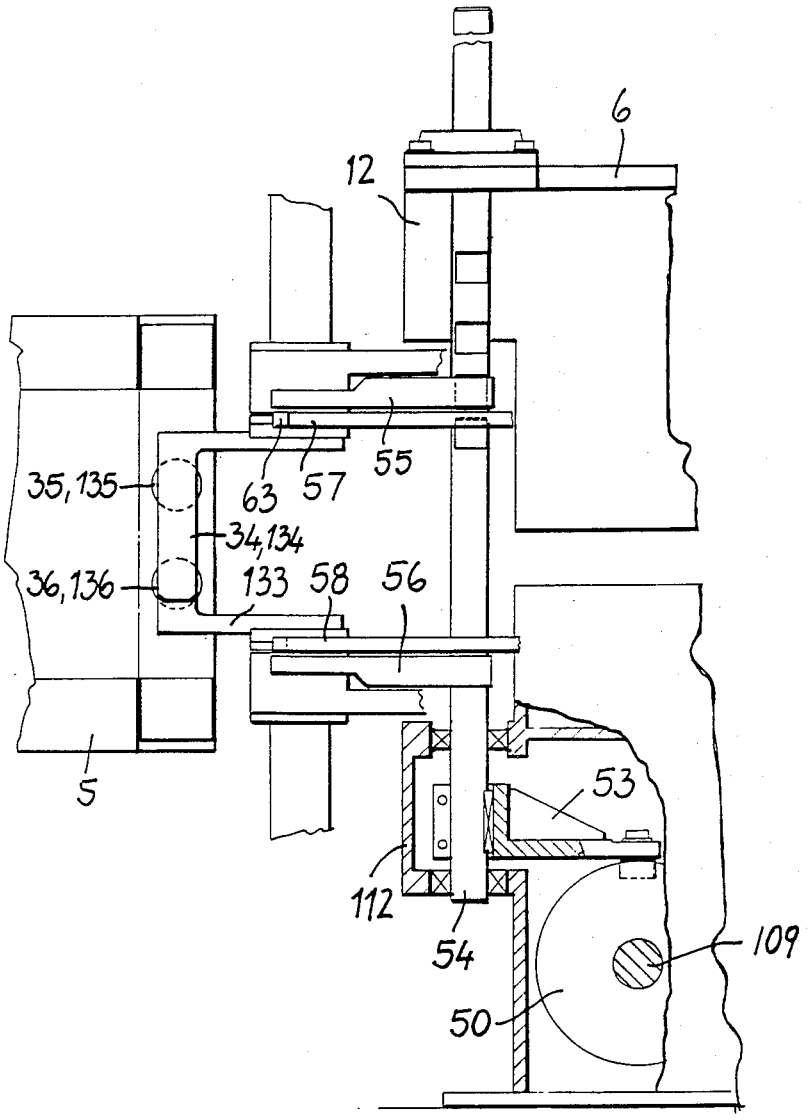
FIG. 3 is a elevation view of the receiving device, in partial cross section along the plane III—III of FIG. 2.

The cam 50 is engaged by the roller of a lever 53 (see FIG. 3) keyed on a vertical shaft 54 which is parallel to the shaft 114. The shaft 54 is rotatably supported in the box-like bracket 112 and two aptly shaped radial arms 55, 56 are rigidly associated thereto and act as pusher elements cooperating with two fixed guides 57, 58 to transfer the bags onto a receiving device consisting of a known removal conveyor generally indicated by the reference numeral 59.

Said conveyor comprises, in its essential elements, useful for the understanding of the present apparatus, a flexible element 60 which follows a circular path at the apparatus. Small equally spaced blocks 61 are arranged on the outer face of the flexible element and define seats 62 adapted to accommodate the individual bags taken from the magazine and opened by virtue of the combined action of the arms 55, 56 and of the guides 57, 58 as will become apparent hereinafter.

According to a basic characteristic of the present invention, the transmission ratio between the main cycle shaft 52*b* and the driven cycle shaft 109 is 2:1. Since the toothed wheels 49 and 149 are identical, each turn of the driven shafts 9, 109 corresponds to half a turn of the main shaft 52*b*.

The cams 10, 11 and 110, 111 are active once every turn of the related shaft 9, 109. On the other hand, the cam 50 which actuates the pushers 55, 56 is active twice every turn of the shaft 109, so that the pushers are capable of acting on the bags taken from both extraction devices 3, 4.

Figure 4:
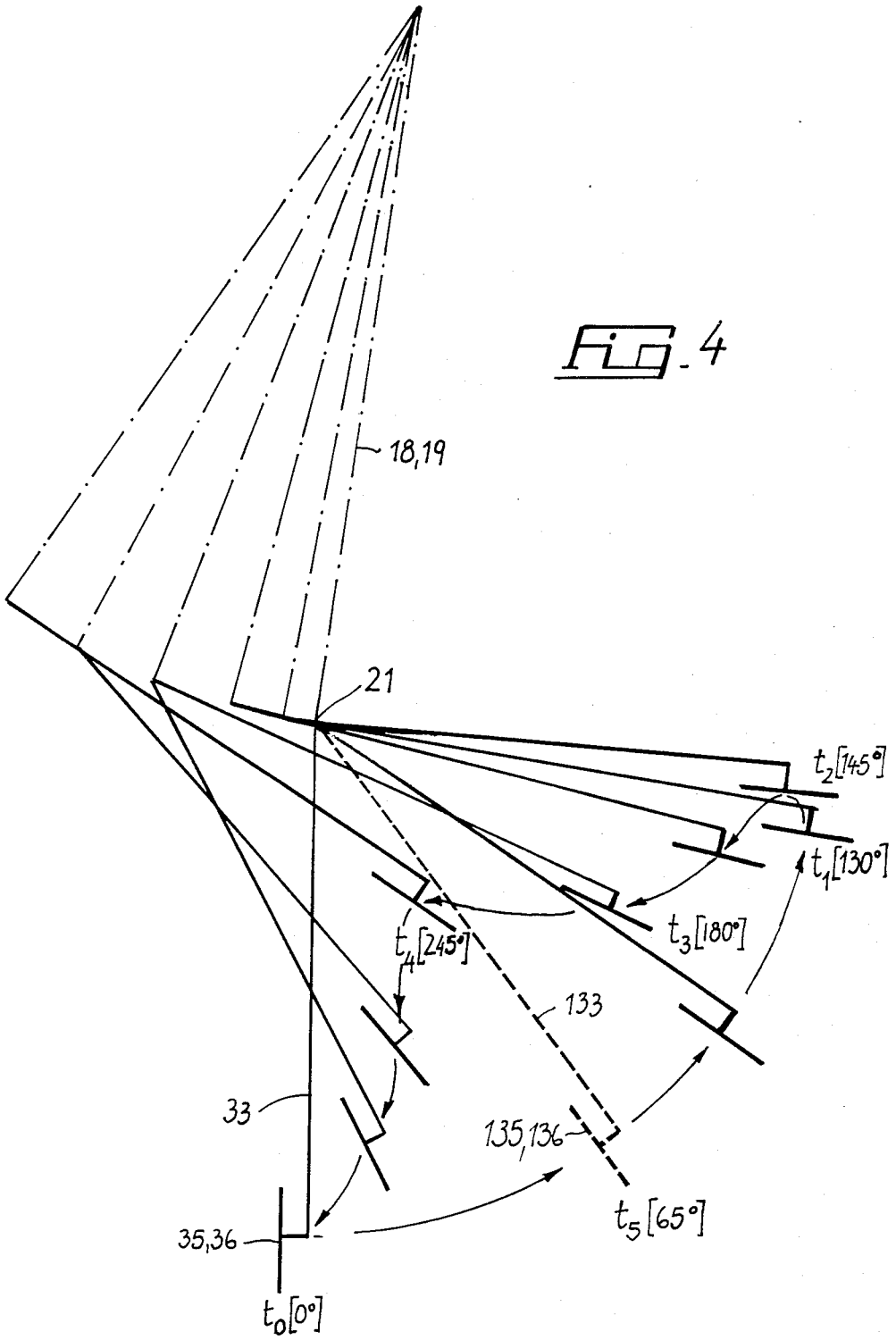
FIG. 4 is a schematic view of a succession of instantaneous positions assumed by the suction cup extraction elements during their stroke.

The operation of the apparatus is described with reference to FIG. 4 which illustrates schematically the position of the suction cups 35, 36 related to the angular position of the shaft 9.

In the starting position $t_0$ (corresponding to 0° of rotation of the shaft 9), the suction cups 35, 36 are in contact with the front bag 5 of the magazine; then, once the suction is activated, begins the rotation of the L-shaped arm 33–34 due to the cam 10 which, through the lever 15, 16, the tension element 17 and the projection 27, actuates the oscillation of the toothed sector 25 which, by meshing with the pinion 24, determines the rotation of the arm 33–34.

The bag 5 taken from the magazine is introduced into the respective seat 62 of the removal conveyor, where, with its free end, it makes contact with the flexible element 60 and is forced to open, gradually assuming a rhomboidal configuration. When the arm 33–34 approaches position $t_1$, corresponding to a rotation through 130° of the shaft 9, the suction phase of the suction cups is interrupted and the oscillation of the pusher arm 55 is actuated, pushing the extracted bag completely into the seat 62. More precisely, the pusher 55 forms, with an initial portion 63 of the fixed guides 57, an angle in which the inner corner of the bag engages, said bag, pushed by the small block 61 downstream with respect to the direction A of the conveyor and due to the simultaneous action exerted by the pusher 55, 56, being therefore progressively opened until it assumes a parallelepipedal configuration.

At $t_1$ the actuation of the cam 11 intervenes and, due to the interposition of the lever 28, causes the plates 18, 19 to oscillate together with the sleeve 20. Consequently, the suction cups 35, 36 begin to trace a path which is different from the one determined by the simple rotation of the pinion 24 due to the sector 25, said path taking the suction cups, once the position $t_2$ of maximum angular excursion has been passed, to a position which is internal with respect to that which they had during the movement from $t_0$ to $t_1$.

With such a path, the suction cups, once they have passed beyond the point $t_3$ corresponding to a rotation through 180° of the shaft 9, reach the point $t_4$ of the maximum deviation corresponding to a rotation through 245° of the shaft 9. At this point begins the phase of the return of the suction cups towards the magazine, for which the oscillation of the plates 18, 19 occurs in the reverse direction simultaneously with the rotation, also in the reverse direction, of the sector 25 and therefore of the arm 33–34.

Naturally, as has been described above, the phases of extraction and release of the bag by the suction cups 35, 36 are alternated with those of the suction cups 135, 136 the actuation whereof occurs in all other respects in a fully identical manner due to the actuation by the cams 110, 111.

However, it must be observed that when the suction cups 35, 36 trace the path from $t_0$ to $t_3$ any possibility of collision with the suction cups 135, 136 is excluded since the latter, due to the 180° phase shift between the shafts 9 and 109, are on the path from $t_3$ to $t_0$. More precisely, in the moment in which the suction cups 35, 36 are about to pass beyond position $t_4$, the suction cups 135, 136 are at $t_5$, corresponding to 65° of rotation of the shaft 109. As is apparent, the distance between the suction cups 35, 36 and the suction cups 135, 136 is such as to allow the same to cross without touching, even taking into account that the extracted bag protrudes slightly inwards with one of its edges.

The operating cycle of the suction cups can be substantially divided into three phases, each of approximately 120°, and more precisely into a first phase from $t_0$ to $t_1$ of 130°, during which occur the extraction and the transfer of the extracted bag into the seat 62 of the conveyor, a second phase from $t_1$ to $t_4$ of 115° during which occurs the removal of the suction cups after the bag has been transferred into the seat 62, and a third phase from $t_4$ to $t_0$ of 115° in which the suction cups are again returned to the extraction position.

Figure 5:
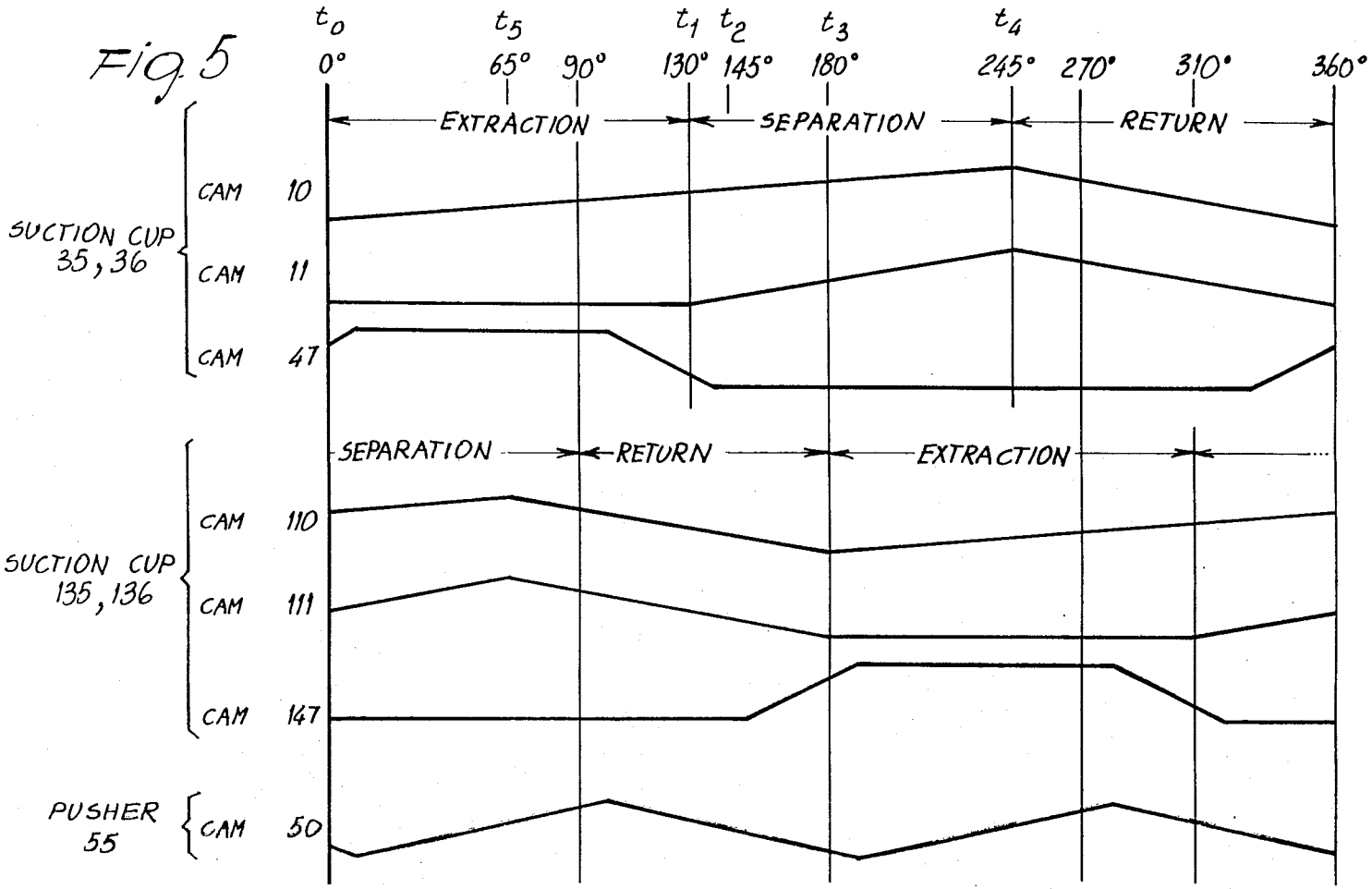
FIG. 5 is a phase diagram of the extraction elements and the respective actuators.

In order to better appreciate the synchronous operation of the suction cups 35, 36, 135, 136 with respect to one another and with respect to the pusher 55, 56, FIG. 5 illustrates the phase diagram of the cams which control the suction cups and the pusher, as well as of the cams 47, 147 which activate and deactivate the suction cups. It can be observed that the activation of the suction cups substantially persists for the time of extraction, during which the cams 47, 147 keep the suction cups connected to the suction means. The suction cups remain deactivated for the time during which they move away and return to the extraction position.

As can be seen, the cam 50 which actuates the pusher 55 has a double period with respect to that of the suction cups in order to perform the transfer of the bags extracted alternately by both devices 3 and 4.

Figure 2:
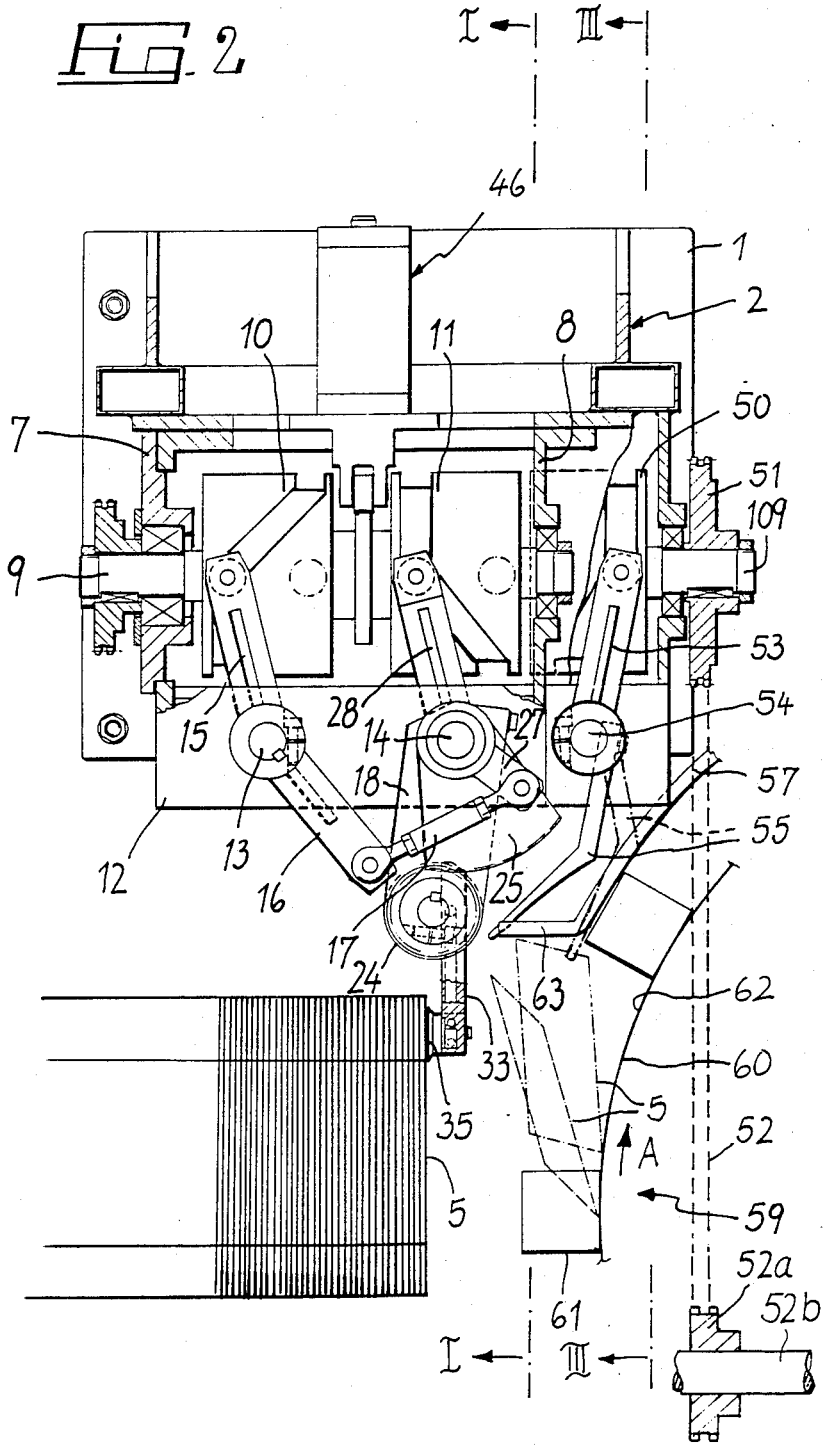
FIG. 2 is a cross section view along the plane II—II of FIG. 1.

In particular during the extraction phase, the pusher 55 shifts from the position illustrated in broken lines in FIG. 2 to the one illustrated in solid lines to allow the suction cups to insert the extracted bag into the seat 62 while, simultaneously with the deactivation of the suction cups, the pusher 55 is actuated in the reverse direction to complete the insertion of the bags into the seats 62.

It has been seen how the invention fully achieves the intended aims. With regard to the main shaft 52*b* it can be observed that the time available to perform the opening of the bags since the transmission ratio between the shaft 52*b* and the shafts 9, 109 is equal to 2:1, is considerably extended. This allows air to enter the bag without the need of high depression valves and the apparatus can be used to open large bags. For example, with the above described values of 130° to perform the extraction, one would have an opening time corresponding to 260° of rotation of the main shaft 52*b*, as opposed to an opening time which in conventional apparatuses is equal, in the best cases, to approximately 160°. The performance of the apparatus is therefore increased by 61.5%.

An important peculiarity of the apparatus described resides in the fact that it can be adapted to bags of various sizes. For this purpose, the upper extraction device 3 is mounted on the column 2 so as to be adjustable in height. The chain 48 would be adapted to the different distance between the shafts 9 and 109. Similarly the upper pusher 55 is shifted along the shaft 54 to the corresponding height of the suction cups 35, 36.

We claim:

1. High speed apparatus for extracting and opening bags contained in a magazine wherein the bags are arranged in a flattened or closed condition so as for form a pack, and for transferring said bags onto a receiving conveyor comprising first and second extraction devices including suction elements, each of said first and second extraction devices comprising a driven cycle shaft, a first and a second cam rigidly associated with said driven cycle shaft, a first and a second shaft supported rotatable perpendicular to said driven cycle shaft and controlled respectively by said first and said second cam, a pair of plates radially fixed to said second shaft, a third shaft supported rotatable in said plates, an L-shaped lever rigidly associated with one end of said third shaft and having one radial arm and one arm parallel to said third shaft on which are arranged said suction elements, a pinion keyed to the opposite end of said third shaft, a toothed sector supported coaxially rotatable with respect to said second shaft, a tension element connecting said sector to a radial arm rigidly associated with said first shaft, said first shaft and said second shaft being actuated so that the suction elements follow, during the extraction and the transfer of said bags towards the receiving conveyor, a path which is different with respect to the path traced for their return to the extraction position, thereby said first and said second extraction devices being supported so as to oscillate between a position of extraction of the bags from said magazine and a position of release thereof onto said receiving conveyor.

2. Apparatus according to claim 1, wherein the phase of extraction and transfer extends through approximately 120°, preferably 130°, of rotation of the driven cycle shaft, and wherein the return to the extraction position comprises a phase of approximately 120°, preferably 115°, for the removal of the suction elements from the extraction and transfer path and a phase of approximately 120°, preferably 115°, of approach to the bag to be extracted.

3. Apparatus according to claim 1, wherein said devices are arranged specularly one above the other and said suction elements follow the same path, and said driven cycle shafts are kinematically connected with a 180° offset.

4. Apparatus according to claim 1, wherein said suction elements are connectable to a suction source through a distributor actuated by a cam arranged on the respective driven cycle shaft.

5. Apparatus according to claim 1, wherein said radial plates are connected to one another by a sleeve wherein said third shaft is rotatably supported.

6. Apparatus according to claim 1, wherein channels are provided for the connection of said suction elements to a suction source through a distributor, said channels extending from the suction elements along said L-shaped lever, leading into a chamber of said third shaft connected to an annular chamber outwardly defined by a collar and said annular chamber being connected to a hole axially provided in said second shaft, said hole being connected through said distributor to said suction source.

* * * * *